US010755642B2

(12) United States Patent
Wang

(10) Patent No.: US 10,755,642 B2
(45) Date of Patent: Aug. 25, 2020

(54) PIXEL DRIVING COMPENSATION CIRCUIT, DISPLAY PANEL AND DRIVING METHOD

(71) Applicants: Beijing BOE Display Technology Co., Ltd., Beijing (CN); BOE TECHNOLOGY GROUP CO., LTD., Beijing (CN)

(72) Inventor: Xue Wang, Beijing (CN)

(73) Assignees: Beijing BOE Display Technology Co., Ltd., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/399,487

(22) Filed: Apr. 30, 2019

(65) Prior Publication Data

US 2020/0058254 A1 Feb. 20, 2020

(30) Foreign Application Priority Data

Aug. 17, 2018 (CN) ..... 2018 1 0941439

(51) Int. Cl.
*G09G 3/3258* (2016.01)
*G09G 3/3266* (2016.01)

(52) U.S. Cl.
CPC ..... *G09G 3/3258* (2013.01); *G09G 3/3266* (2013.01); *G09G 2300/0876* (2013.01); *G09G 2310/061* (2013.01); *G09G 2320/0233* (2013.01)

(58) Field of Classification Search
CPC ..... G09G 3/3266; G09G 3/3258; G09G 2300/0876; G09G 2310/061; G09G 2320/0233; G09G 3/3233
See application file for complete search history.

(56) References Cited

U.S. PATENT DOCUMENTS

| | | | | |
|---|---|---|---|---|
| 2016/0246424 | A1* | 8/2016 | Yang | G09G 3/3291 |
| 2016/0274692 | A1* | 9/2016 | Yang | G09G 3/3233 |
| 2016/0372048 | A1* | 12/2016 | Wang | G09G 3/2003 |
| 2017/0270853 | A1* | 9/2017 | Xiang | G09G 3/3275 |

* cited by examiner

*Primary Examiner* — Premal R Patel
(74) *Attorney, Agent, or Firm* — Thomas | Horstemeyer LLP

(57) ABSTRACT

A pixel driving compensation circuit, a display panel, and a driving method are provided. The pixel driving circuit includes: a scan sub-circuit, a storage sub-circuit, a first reset sub-circuit, a second reset sub-circuit, a control sub-circuit, and a drive sub-circuit. The scan sub-circuit is connected to scan and data signal terminals and a first terminal of the storage sub-circuit. The first reset sub-circuit is connected to a reset signal terminal, and the first terminal of the storage sub-circuit. The second reset sub-circuit is connected to the reset signal terminal, an initial signal terminal, a second terminal of the storage sub-circuit, and the drive sub-circuit. The control sub-circuit is connected to a first power supply voltage terminal, and a control signal terminal. The drive sub-circuit is connected to the second terminal of the storage sub-circuit, and a second power supply voltage terminal.

19 Claims, 2 Drawing Sheets

PIXEL DRIVING COMPENSATION CIRCUIT, DISPLAY PANEL AND DRIVING METHOD

CROSS REFERENCE TO RELATED APPLICATION

This application is based upon, and claims the benefit of and priority to, Chinese Patent Application No. 201810941439.2, filed on Aug. 17, 2018, the entire contents thereof being incorporated herein by reference.

TECHNICAL FIELD

The present disclosure relates to the field of pixel driving and related technology and, in particular, to a pixel driving compensation circuit, a display panel, and a driving method.

BACKGROUND

An organic light emitting diode (OLED) display device has advantages of low power consumption, high color gamut, high brightness, high resolution, wide viewing angle, high response speed, and the like. OLED display devices can be classified into two types: passive matrix OLEDs (PMOLEDs) and active matrix OLEDs (AMOLEDs) according to the driving method. The AMOLED has pixels arranged in an array, which belongs to an active display type, has high luminous efficiency, and is generally used as a high-definition large-sized display device.

AMOLED-based devices are current driven devices. When a current flows through the organic light emitting diode, the organic light emitting diode emits light, and the luminance of the light is determined by the current passing through the OLED itself. The conventional AMOLED pixel driving circuit is usually 2T1C, that is, a structure in which two thin film transistors and one capacitor are used to convert a voltage signal into a current signal. Such a pixel driving circuit is sensitive to the threshold voltage and channel mobility of the thin film transistor, the starting voltage, and quantum efficiency of the organic light emitting diode, and the transient process of the power supply. The threshold voltage based on the driving thin film transistor and the organic light emitting diode drifts with the time of operation, thereby causing the light emission of the organic light emitting diode to be unstable, causing differences in brightness in the display screen, and reducing the picture quality and the service life.

Therefore, in the process of implementing the present application, it has been found that the related art has at least the following problem: the current design for pixel driving cannot overcome the instability problem caused by threshold voltage drift of transistors and light emitting components, affecting display quality and service life.

SUMMARY

In a first aspect, an embodiment of the present disclosure provides a pixel driving compensation circuit, comprising: a scan sub-circuit, a storage sub-circuit, a first reset sub-circuit, a second reset sub-circuit, a control sub-circuit, and a drive sub-circuit; wherein: the scan sub-circuit is respectively connected to a scan signal terminal, a data signal terminal and a first terminal of the storage sub-circuit, and is configured to input a data signal to the first terminal of the storage sub-circuit according to the control of the scan signal terminal; the first reset sub-circuit is respectively connected to a reset signal terminal and the first terminal of the storage sub-circuit; the second reset sub-circuit is respectively connected to the reset signal terminal, an initial signal terminal, a second terminal of the storage sub-circuit, and the drive sub-circuit, and is configured to input an initial signal to the second terminal of the storage sub-circuit and the drive sub-circuit simultaneously according to the control of the reset signal terminal; the control sub-circuit is respectively connected to a first power supply voltage terminal, and a control signal terminal; and the drive sub-circuit is respectively connected to the second terminal of the storage sub-circuit and a second power supply voltage terminal.

Optionally, the pixel driving compensation circuit further comprises a light emitting component, wherein: a first terminal of the light emitting component is connected to the first reset sub-circuit, and the first reset sub-circuit is configured to input a signal of the first terminal of the storage sub-circuit to the first terminal of the light emitting component according to the control of the reset signal terminal; the first terminal of the light emitting component is further connected to the control sub-circuit, and the control sub-circuit is configured to input a first power supply voltage signal of the first power supply voltage terminal to the first terminal of the light emitting component according to the control of the control signal terminal; a second terminal of the light emitting component is connected to the drive sub-circuit, and the drive sub-circuit is configured to control the second terminal of the light emitting component and the second power supply voltage terminal to be conducted or not according to the control of the second terminal of the storage sub-circuit, to implement light emitting control.

Optionally, the scan sub-circuit includes a scan transistor. The scan transistor has a gate electrode connected to the scan signal terminal, a first electrode connected to the data signal terminal, and a second electrode connected to the first terminal of the storage sub-circuit; wherein the first electrode of the scan transistor is a source electrode or a drain electrode, and the second electrode of the scan transistor is a drain electrode or a source electrode corresponding to the first electrode of the scan transistor.

Optionally, the storage sub-circuit includes a storage capacitor, the storage capacitor has one terminal is the first terminal of the storage sub-circuit, and the storage capacitor has another terminal is the second terminal of the storage sub-circuit.

Optionally, the first reset sub-circuit includes a first reset transistor. The first reset transistor has a gate electrode connected to the reset signal terminal, a first electrode connected to the first terminal of the storage sub-circuit, and a second electrode connected to the first terminal of the light emitting component; wherein the first electrode of the first reset transistor is a source electrode or a drain electrode, and the second electrode of the first reset transistor is a drain electrode or a source electrode corresponding to the first electrode of the first reset transistor.

Optionally, the second reset sub-circuit includes a second reset transistor, where the second reset transistor has a gate electrode connected to the reset signal terminal, a first electrode connected to the initial signal terminal, and a second electrode connected to the drive sub-circuit; wherein the first electrode of the second reset transistor is a source electrode or a drain electrode, and the second electrode of the second reset transistor is a drain electrode or a source electrode corresponding to the first electrode of the second reset transistor.

Optionally, the control sub-circuit includes a control transistor. The control transistor has a gate electrode connected to the control signal terminal; a first electrode connected to the first power supply voltage terminal, and a second electrode connected to the first terminal of the light emitting component; wherein the first electrode of the control transistor is a source electrode or a drain electrode, and the second electrode of the control transistor is a drain electrode or a source electrode corresponding to the first electrode of the control transistor.

Optionally, the drive sub-circuit includes a drive transistor. The drive transistor has a gate electrode connected to the second terminal of the storage sub-circuit, a first electrode connected to the second terminal of the light emitting component, and a second electrode connected to the second power supply voltage terminal; wherein the first electrode of the drive transistor is a source electrode or a drain electrode, and the second electrode of the drive transistor is a drain electrode or a source electrode corresponding to the first electrode of the drive transistor.

Optionally, the scan sub-circuit is a scan transistor, the storage sub-circuit is a storage capacitor, the first reset sub-circuit is a first reset transistor, and the second reset sub-circuit is a second reset transistor, the control sub-circuit is a control transistor, and the drive sub-circuit is a drive transistor;

the scan transistor has a gate electrode connected to the scan signal terminal, a first electrode connected to the data signal terminal, and a second electrode connected to a first terminal of the storage capacitor;

the first reset transistor has a gate electrode connected to the reset signal terminal, a first electrode connected to the first terminal of the storage capacitor, and a second electrode connected to an anode of the light emitting component;

the second reset transistor has a gate electrode connected to the reset signal terminal, a first electrode connected to the initial signal terminal, and a second electrode connected to a gate electrode of the drive transistor;

the control transistor has a gate electrode connected to the control signal terminal; a first electrode connected to the first power supply voltage terminal, and a second electrode connected to the anode of the light emitting component; and the drive transistor has the gate electrode connected to a second terminal of the storage capacitor, a first electrode connected to a cathode of the light emitting component, and a second electrode connected to the second power supply voltage terminal, wherein the first electrode of each of the scan transistor, the first reset transistor, the second reset transistor, the control transistor, and the drive transistor is one of a source electrode and a drain electrode, and the second electrode of each of the scan transistor, the first reset transistor, the second reset transistor, the control transistor, and the drive transistor is the other of the source electrode and the drain electrode.

In a second aspect, an embodiment of the present application provides a display panel, including the pixel driving compensation circuit described above.

In a third aspect, an embodiment of the present application also provides a driving method of the pixel driving compensation circuit described above, wherein the driving method includes a reset stage, a driving stage, and a light emitting stage in sequence;

in the reset stage, the reset signal terminal controls the first reset sub-circuit to conduct the first terminal of the storage sub-circuit with the first terminal of the light emitting component, and further controls the second reset sub-circuit to input an initial signal of the initial signal terminal to a second terminal of the storage sub-circuit and the drive sub-circuit; the scan signal terminal controls the scan sub-circuit to be turned off; and the control signal terminal controls the control sub-circuit to be turned off;

in the driving stage, the scan signal terminal controls the scan sub-circuit to input a data signal of the data signal terminal to the first terminal of the storage sub-circuit; the reset signal terminal controls the first reset sub-circuit and the second reset sub-circuit to be turned off; and the control signal terminal controls the control sub-circuit to be turned off; and in the light emitting stage, the scan signal terminal controls the scan sub-circuit to be turned off; the reset signal terminal controls the first reset sub-circuit and the second reset sub-circuit to be turned off; the control signal terminal controls the control sub-circuit to input a first power supply voltage signal of the first power supply voltage terminal to the first terminal of the light emitting component, to cause the light emitting component to emit light.

DETAILED DESCRIPTION

In order to make the objectives, technical solutions, and advantages of the present disclosure more clear, the present disclosure will be further described in detail below with reference to the specific embodiments of the present disclosure.

It should be noted that all the expressions using "first" and "second" in the embodiment of the present disclosure are used to distinguish two entities with the same name that are not the same or non-identical parameters. Therefore, "first" and "second" are merely for the convenience of the description, and should not be construed as limiting the embodiments of the present disclosure, which will not be repeatedly noted in subsequent embodiments.

In the description of the present specification, description referring to the terms "certain embodiments", "one embodiment", "some embodiments", "illustrative embodiments", "example", "specific examples", or "some examples" means that specific features, structures, materials or characteristics described in connection with the embodiments or examples are included in at least one embodiment or example of the present disclosure. In the present specification, the schematic representation of the above terms does not necessarily mean the same embodiment or example. Furthermore, the particular features, structures, materials, or 0.7 characteristics described may be combined in a suitable manner in any one or more embodiments or examples.

The present application is directed to the problem that the related art cannot overcome the instability problem caused by threshold voltage drift of light emitting components and/or transistors, and provides a compensation design, which can overcome a series of problems caused by threshold voltage drifts in the related art.

Figure 1:
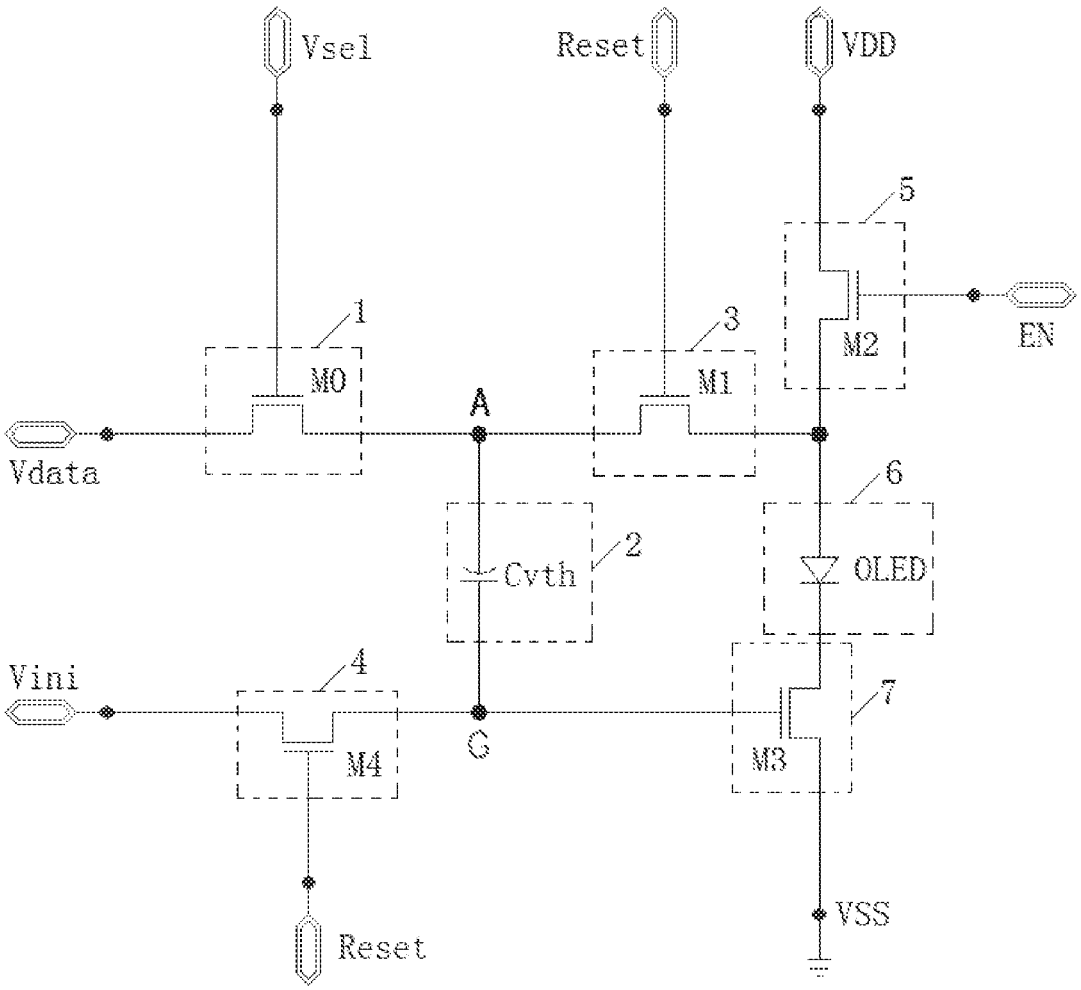
FIG. 1 is a schematic structural diagram of an embodiment of a pixel driving compensation circuit provided by the present application.

Specifically, referring to FIG. 1, a schematic structural diagram of an embodiment of a pixel driving compensation circuit provided by the present application is shown. As shown in the figure, the pixel driving compensation circuit of the embodiment of the present application includes: a scan sub-circuit 1, a storage sub-circuit 2, a first reset sub-circuit 3, a second reset sub-circuit 4, a control sub-circuit 5, a light emitting component 6, and a drive sub-circuit 7.

The scan sub-circuit 1 is respectively connected to a scan signal terminal Vsel, a data signal terminal Vdata, and a first terminal of the storage sub-circuit 2, and is configured to input a data signal to the first terminal of the storage sub-circuit 2 according to the control of the scan signal terminal Vsel. The data signal is from the data signal terminal Vdata. This enables control of whether to input the data signal to the storage sub-circuit 2 by adjusting the signal of the scan signal terminal Vsel.

The first reset sub-circuit 3 is respectively connected to a reset signal terminal Reset, the first terminal of the storage sub-circuit 2, and a first terminal of the light emitting component 6, and is configured to input a signal of the first terminal of the storage sub-circuit 2 to the first terminal of the light emitting component 6 according to the control of the reset signal terminal Reset. Since the control of the storage sub-circuit 2 on the light emitting component 6 can be stably maintained, generally, the storage sub-circuit 2 and the light emitting component 6 may be connected in parallel. One terminal of the storage sub-circuit 2 and the light emitting component 6 can be controlled to be conducted or not by way of the first reset sub-circuit 3 and the reset signal terminal Reset.

The second reset sub-circuit 4 is respectively connected to the reset signal terminal Reset, an initial signal terminal Vini, a second terminal of the storage sub-circuit 2, and the drive sub-circuit 7, and is configured to input an initial signal to the second terminal of the storage sub-circuit 2 and the drive sub-circuit 7 simultaneously according to the control of the reset signal terminal Reset. The initial signal comes from the initial signal terminal Vini. In this regard, the storage sub-circuit 2 and the drive sub-circuit 7 can be reset to avoid interference of the signal in the light emitting process to the next control signal.

The control sub-circuit 5 is respectively connected to a first power supply voltage terminal VDD, a control signal terminal EN and a first terminal of the light emitting component 6, and is configured to input a first power supply voltage signal of the first power supply voltage terminal VDD to the first terminal of the light emitting component 6 according to the control of the control signal terminal EN. That is, the light emitting control on the light emitting component can be achieved by the control signal terminal EN controlling application of a power supply voltage signal on one terminal of the light emitting component, together with a voltage on the other terminal thereof.

The drive sub-circuit 7 is respectively connected to the second terminal of the light emitting component 6, the second terminal of the storage sub-circuit 2, and a second power supply voltage terminal VSS, and is configured to control the second terminal of the light emitting component 6 and the second power supply voltage terminal VSS to be conducted or not according to the control of the second terminal of the storage sub-circuit 2. Finally, together with the driving of the first power supply voltage on the other terminal, a voltage difference can be generated between the two terminals of the light emitting component 6, thus achieving control of light emitting of the light emitting component 6. It should be noted that the voltage values of the first power supply voltage terminal VDD and the second power supply voltage terminal VSS can be adjusted in design according to the driving voltage difference required by the actual light emitting sub-circuit, which is not specifically limited in this embodiment.

It can be seen from the above embodiment that the pixel driving compensation circuit of the present application is designed by combining the storage sub-circuit, the first reset sub-circuit, and the second reset sub-circuit, so that the light emitting component enters the light emitting stage after the reset process and the driving process. By utilizing the storage characteristics of the storage sub-circuit, the drift of the threshold voltage based on the light emitting component and the drive sub-circuit can be stored and then compensated and offset in the light emitting stage, so that the light emitting component will not be affected by the instability caused by the threshold voltage drift. That is, the present application can compensate for the drift of the threshold voltage of the relevant element, thereby prolonging the service life of the light emitting component, improving the uniformity of the image quality of the display screen, and improving the display quality.

Further, in order to more clearly illustrate the compensation process and mechanism of the embodiments of the present application, in some embodiments of the present application, description will be made taking an OLED as a light emitting component, and a transistor as a corresponding sub-circuit as an example.

In the embodiment, optionally, the scan sub-circuit 1 includes a scan transistor M0. The scan transistor M0 has a gate electrode connected to the scan signal terminal Vsel, a first electrode connected to the data signal terminal Vdata, and a second electrode connected to the first terminal of the storage sub-circuit 2, where the first electrode of the scan transistor M0 is a source electrode or a drain electrode, and the second electrode of the scan transistor M0 is a drain electrode or a source electrode corresponding to the first electrode of the scan transistor M0. Thus, by utilizing a transistor as the element of the scan sub-circuit 1, it can be implemented in the field of pixel driving, and also can make the control more accurate and stable.

It should be noted that the transistor in the above embodiment of the present application is only an embodiment of the scan sub-circuit 1. In fact, based on the idea of the present application, the transistor not only can be substituted for by other components or circuits having the same function, but also can be added with some auxiliary components based thereon to provide more auxiliary effects, which is not limited in the embodiment. It applies similarly to the storage sub-circuit, the first reset sub-circuit, the second reset sub-circuit, the control sub-circuit, and the drive sub-circuit in the subsequent embodiments of the present application, details of which will not be repeated herein.

In some optional embodiments of the present application, the storage sub-circuit 2 includes a storage capacitor Cvth; with one terminal of the storage capacitor Cvth is the first terminal of the storage sub-circuit 2, and the other terminal of the storage capacitor Cvth is the second terminal of the storage sub-circuit 2.

In some optional embodiments of the present application, the first reset sub-circuit 3 includes a first reset transistor M1. The first reset transistor M1 has a gate electrode connected to the reset signal terminal Reset, a first electrode connected to the first terminal of the storage sub-circuit 2, and a second electrode connected to the first terminal of the light emitting component 6; wherein the first electrode of the first reset transistor M1 is a source electrode or a drain electrode, and the second electrode of the first reset transistor M1 is a drain electrode or a source electrode corresponding to the first electrode of the first reset transistor M1.

In some optional embodiments of the present application, the second reset sub-circuit 4 includes a second reset transistor M4. The second reset transistor M4 has a gate electrode connected to the reset signal terminal Reset, a first electrode connected to the initial signal terminal Vini, and a second electrode connected to the drive sub-circuit 7, where the first electrode of the second reset transistor M4 is a source electrode or a drain electrode, and the second electrode of the second reset transistor M4 is a drain electrode or a source electrode corresponding to the first electrode of the second reset transistor M4.

In some optional embodiments of the present application, the control sub-circuit 5 includes a control transistor M2. The control transistor M2 has a gate electrode connected to the control signal terminal EN, a first electrode connected to the first power supply voltage terminal VDD, and a second electrode connected to the first terminal of the light emitting component 6, where the first electrode of the control transistor M2 is a source electrode or a drain electrode, and the second electrode of the control transistor M2 is a drain electrode or a source electrode corresponding to the first electrode of the control transistor M2.

In some optional embodiments of the present application, the drive sub-circuit 7 includes a drive transistor M3. The drive transistor M3 has a gate electrode connected to the second terminal of the storage sub-circuit 2, a first electrode connected to the second terminal of the light emitting component 6, and a second electrode connected to the second power supply voltage terminal VSS, where the first electrode of the drive transistor M3 is a source electrode or a drain electrode, and the second electrode of the drive transistor M3 is a drain electrode or a source electrode corresponding to the first electrode of the drive transistor M3.

In the above embodiment, the scan sub-circuit, the storage sub-circuit, the first reset sub-circuit, the second reset sub-circuit, the control sub-circuit, and the drive sub-circuit may all be implemented in transistors to achieve the function of the corresponding sub-circuit. It is also possible to substitute one or more sub-circuits in different circuit design, which is not limited in the embodiment of the present application. An implementation can be obtained when all the sub-circuits are implemented in transistors, and the light emitting component is an OLED.

The scan sub-circuit 1 is a scan transistor M0, the storage sub-circuit 2 is a storage capacitor Cvth, the first reset sub-circuit 3 is a first reset transistor M1, the second reset sub-circuit 4 is a second reset transistor M4, and the control sub-circuit 5 is a control transistor M2, and the drive sub-circuit 7 is a drive transistor M3. The connection relationship between the transistors is as follows.

The scan transistor M0 has the gate electrode connected to the scan signal terminal Vsel, the first electrode connected to the data signal terminal Vdata, and the second electrode connected to the first terminal of the storage capacitor Cvth. The first reset transistor M1 has the gate electrode connected to the reset signal terminal Reset, the first electrode connected to the first terminal of the storage capacitor Cvth, and the second electrode connected to the anode of the light emitting component OLED. The second reset transistor M4 has the gate electrode connected to the reset signal terminal Reset, the first electrode connected to the initial signal terminal Vini, and the second electrode connected to the gate electrode of the drive transistor M3 and the second terminal of the storage capacitor Cvth. The control transistor M2 has the gate electrode connected to the control signal terminal EN, the first electrode connected to the first power supply voltage terminal VDD, and the second electrode connected to the anode of the OLED. The drive transistor M3 has the gate electrode connected to the second terminal of the storage capacitor Cvth, the first electrode connected to a cathode of the OLED, and the second electrode connected to the second power supply voltage terminal VSS.

The first electrode of each of the scan transistor M0, the first reset transistor M1, the second reset transistor M4, the control transistor M2, and the drive transistor M3 is one of a source electrode and a drain electrode, and the second electrode of each of the scan transistor M0, the first reset transistor M1, the second reset transistor M4, the control transistor M2, and the drive transistor M3 is the other of the source electrode and the drain electrode.

Figure 2:
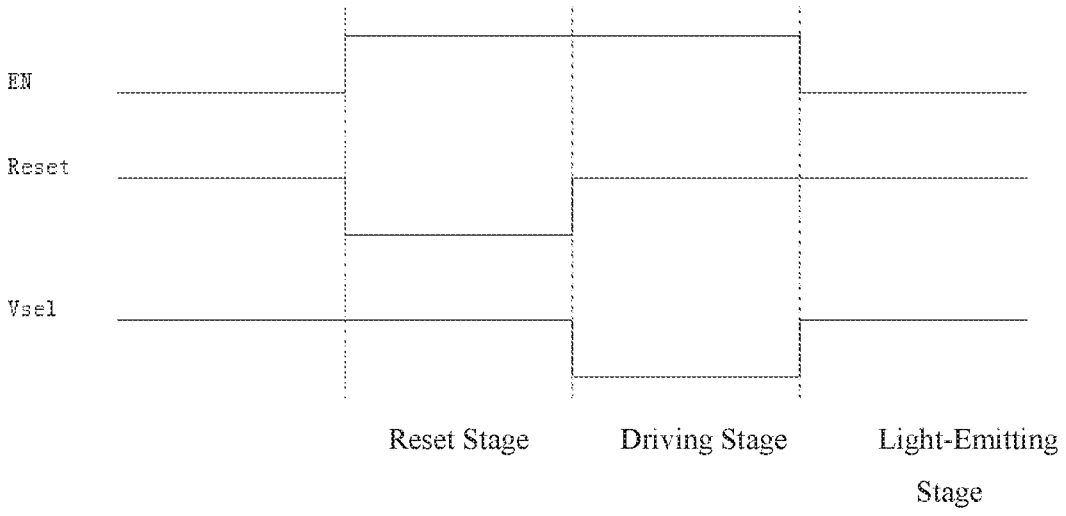
FIG. 2 is a driving timing diagram of an embodiment of a pixel driving compensation circuit provided by the present application.

It should be noted that, since the transistors have different driving characteristics, for example, the transistor can be divided into an N-type transistor and a P-type transistor, the transistors in the above embodiment of the present application can be driven by a low voltage (for example, the driving voltage is a negative voltage) or a high voltage (for example, a driving voltage is a positive voltage). Specifically, when the transistor is a P-type transistor, as shown in FIG. 2, it can be driven with a negative voltage. That is, when the gate electrode of the transistor is connected to a negative voltage, the transistor can be turned on. For example, referring to FIG. 2, in the reset stage, only when the reset signal terminal Reset is at a low level or a negative voltage, the first reset transistor M1 and the second reset transistor M4 can be turned on. This is the same case for the driving stage and the light emitting stage. On the contrary, if the above transistor is an N-type transistor, the driving will be performed with a corresponding positive voltage. The specific value of the voltage can be adapted according to the actual driving voltage required by the transistor, which is not limited in the embodiment of the present application.

Further, referring to FIG. 2, which is a driving timing diagram of one embodiment of the pixel driving compensation circuit provided by the present application, as can be seen from the figure, in general, corresponding to the pixel drive control, the OLED has to be controlled to repeatedly undergo a reset stage, a driving stage, and a light emitting stage, so that signal control of different timings does not interfere with each other.

The driving method of the pixel driving compensation circuit can be obtained by combining the timing diagram in FIG. 2 and the driving circuit in FIG. 1, and the driving method includes a reset stage, a driving stage, and a light emitting stage in sequence.

In the reset stage, the reset signal terminal controls the first reset sub-circuit to conduct the first terminal of the storage sub-circuit with the first terminal of the light emitting component, and further controls the second reset sub-circuit to input an initial signal of the initial signal terminal to a second terminal of the storage sub-circuit and the drive sub-circuit. The scan signal terminal controls the scan sub-circuit to be turned off; and the control signal terminal controls the control sub-circuit to be turned off.

In the driving stage, the scan signal terminal controls the scan sub-circuit to input a data signal of the data signal terminal to the first terminal of the storage sub-circuit. The reset signal terminal controls the first reset sub-circuit and the second reset sub-circuit to be turned off; and the control signal terminal controls the control sub-circuit to be turned off.

In the light emitting stage, the scan signal terminal controls the scan sub-circuit to be turned off; the reset signal terminal controls the first reset sub-circuit and the second reset sub-circuit to be turned off. The control signal terminal controls the control sub-circuit to input a first power supply voltage signal of the first power supply voltage terminal to the first terminal of the light emitting component, to cause the light emitting component to emit light.

In this regard, through the above-mentioned control conditions of the reset stage and the driving stage, the threshold voltage drift of the drive sub-circuit and the light emitting component will be stored in the storage sub-circuit, and thus will be cancelled by each other in the final light emitting stage. That is, it can realize compensation of the threshold voltage drift, and can improve the display quality and prolong the service life.

More specifically, the embodiment of the present application will be described by taking a transistor driven by a low voltage as an example, and the driving process is as follows.

In the reset stage, it can be seen from the timing diagram that both the control signal terminal EN and the scan signal terminal Vsel are at a high level, so that the control transistor M2 and the scan transistor M0 are turned off. The reset signal terminal Reset is at a low level, and thus, the first reset transistor M1 and the second reset transistor M4 are turned on. At this time, the anode of the OLED and a contact A are conducted, and the gate electrode of the drive transistor M3 is conducted with a contact G. Since the reset stage is switched from the previous light emitting stage, at the reset stage, the drive transistor M3 can be turned off. That is, a voltage difference between the contact A and the contact G equals to a sum of the threshold voltages of the OLED and the drive transistor M3, and the voltage Vc across the storage capacitor Cvth is obtained as $Vc=V_{GA}=Vth1+Vth2$, where Vth1 is the threshold voltage of the drive transistor and Vth2 is the threshold voltage of the OLED.

In the driving stage, the control signal terminal EN and the reset signal terminal Reset are at high levels, so that the transistor M2, the first reset transistor M1 and the second reset transistor M4 are controlled to be turned off. The scan signal terminal Vsel is at a low level, and thus the scan transistor M0 is turned on, so that the voltage signal of the data signal terminal is input to the first terminal of the storage capacitor Cvth, that is, to the contact A. This will make VA=Vdata, and the VG is obtained as $V_G=V_A+V_{GA}=Vdata+Vth1+Vth2$, since the capacitor has a characteristic that the instantaneous voltage difference remains unchanged.

In the light emitting stage, the scan signal terminal Vsel and the reset signal terminal Reset are at high levels, so that the scan transistor M0, the first reset transistor M1 and the second reset transistor M4 are turned off. The control signal terminal EN is at a low level, and thus the transistor M2 is controlled to be turned on. At this time, the driving current of the light emitting component OLED is $I=K*(Vgs-Vth)^2=K*(Vdata+Vth1+Vth2-Vs-Vth1-Vth2)^2=K*(Vdata-Vdd)^2$, where Vs=Vdd; Vgs=VG−Vs=Vdata+Vth1+Vth2−Vdd; and Vth=Vth1+Vth2. Thus, the resulted saturation current of the OLED is no longer affected by the threshold voltages of the drive transistor and the OLED, thereby realizing the compensation of the saturation current by the pixel compensation circuit and eliminating the influence of Vth drift.

In addition, in combination with the process of continuously repeating the driving signal of the pixel driving circuit in FIG. 2, in fact, the first reset sub-circuit (such as M1) and the second reset sub-circuit (such as M4) in the embodiment of the present application are required to be working in cooperation. For example, when the first reset sub-circuit and the second reset sub-circuit are transistors, the reset principle of the embodiment of the present application is as follows. First, the first reset transistor M1 is turned on under the driving of the reset signal terminal Reset, so that the anode of the OLED and the first terminal of the storage capacitor Cvth are conducted. At the same time, since the second terminal of the storage capacitor Cvth remains conducted with the gate electrode of the drive transistor M3, during the switching process from the light emitting stage to the reset stage, while the drive transistor M3 is turned off, a voltage difference between the gate electrode of the drive transistor M3 and the anode of the OLED is stored in the storage capacitor Cvth, and the voltage difference between the gate electrode of the drive transistor M3 and the anode of the OLED is the sum of the threshold voltage of the drive transistor M3 and the threshold voltage of the OLED. At the same time, since the second reset transistor M4 is turned on under the driving of the reset signal terminal Reset, the voltage at the second terminal of the drive transistor M3 and the voltage at the gate electrode of the drive transistor M3 become the voltage at the initial signal terminal. In this regard, it not only can realize control of the voltages at the corresponding contact A and the contact G, but also can stored the threshold voltage of the drive transistor M3 and the threshold voltage of the OLED in the storage capacitor Cvth so that when the drive transistor M3 is turned on later, they can be cancelled by each other based on the potential control, that is, threshold voltage compensation can be achieved.

In still other alternative embodiments of the present application, a display panel and a terminal including the display panel are disclosed. The display panel includes the pixel driving compensation circuit of any of the above. The terminal here includes various terminal devices such as a mobile phone, a tablet, a notebook, and the like, which are not limited in the embodiment of the present application.

It should be understood by those of ordinary skill in the art that any of the above embodiments is merely exemplary, and is not intended to suggest that the scope of the disclosure (including the claims) is limited to these examples. In the idea of the present disclosure, the technical features in the above embodiments or different embodiments may also be combined. The steps can be carried out in any order. There are many other variations of the various aspects of the present disclosure as described above, which are not provided in detail for the sake of brevity.

In addition, well-known power/ground connections to integrated circuit (IC) chips and other components may or may not be shown in the drawings provided for simplicity of illustration and discussion, and in order not to obscure the present disclosure. In addition, the apparatus may be shown in a block diagram in order to avoid obscuring the present disclosure, and this also contemplates the fact that the details of the embodiments of the apparatus in the block diagram are highly dependent on the platform on which the present disclosure is to be implemented (i.e. these details should be fully understood by those skilled in the art). In the case where the specific details (e.g., circuits) are described to describe the exemplary embodiments of the present disclosure, it will be apparent to those skilled in the art that the present disclosure can be practiced without such specific details or with variations of such specific details. Accordingly, the description is to be considered as illustrative rather than restrictive.

Although the present disclosure has been described in connection with the specific embodiments of the present disclosure, many alternatives, modifications, and variations of the embodiments are apparent to those skilled in the art.

For example, other storage architectures (e.g., dynamic RAM (DRAM)) may be applied in the embodiments discussed.

All such alternatives, modifications and variations fell within the scope of the appended claims are intended to be covered by the embodiments of the present disclosure. Therefore, any omissions, modifications, equivalents, improvements, etc., which are within the spirit and scope of the present disclosure, are intended to be included within the protective scope of the present disclosure.

What is claimed is:

1. A pixel driving compensation circuit, comprising:

a scan sub-circuit, a storage sub-circuit, a first reset sub-circuit, a second reset sub-circuit, a control sub-circuit, and a drive sub-circuit, wherein:

the scan sub-circuit is respectively connected to a scan signal terminal, a data signal terminal, and a first terminal of the storage sub-circuit, the scan sub-circuit being configured to input a data signal to the first terminal of the storage sub-circuit according to a control of the scan signal terminal;

the first reset sub-circuit is respectively connected to a reset signal terminal and the first terminal of the storage sub-circuit;

the second reset sub-circuit is respectively connected to the reset signal terminal, an initial signal terminal, a second terminal of the storage sub-circuit, and the drive sub-circuit, the second reset sub-circuit configured to input an initial signal to the second terminal of the storage sub-circuit and the drive sub-circuit simultaneously according to a control of the reset signal terminal;

the control sub-circuit is respectively connected to a first power supply voltage terminal, and a control signal terminal; and the drive sub-circuit is respectively connected to the second terminal of the storage sub-circuit and a second power supply voltage terminal.

2. The pixel driving compensation circuit according to claim 1, further comprising a light emitting component, wherein:

a first terminal of the light emitting component is connected to the first reset sub-circuit, and the first reset sub-circuit is configured to input a signal of the first terminal of the storage sub-circuit to the first terminal of the light emitting component according to the control of the reset signal terminal;

the first terminal of the light emitting component is further connected to the control sub-circuit, and the control sub-circuit is configured to input a first power supply voltage signal of the first power supply voltage terminal to the first terminal of the light emitting component according to the control of the control signal terminal; and a second terminal of the light emitting component is connected to the drive sub-circuit, and the drive sub-circuit is configured to control the second terminal of the light emitting component and the second power supply voltage terminal to be conducted or not according to the control of the second terminal of the storage sub-circuit, to implement light emitting control.

3. The pixel driving compensation circuit according to claim 1, wherein:

the scan sub-circuit comprises a scan transistor;

the scan transistor has a gate electrode connected to the scan signal terminal, a first electrode connected to the data signal terminal, and a second electrode connected to the first terminal of the storage sub-circuit; and the first electrode of the scan transistor is a source electrode or a drain electrode, and the second electrode of the scan transistor is a drain electrode or a source electrode corresponding to the first electrode of the scan transistor.

4. The pixel driving compensation circuit according to claim 1, wherein:

the storage sub-circuit comprises a storage capacitor; and two terminals of the storage capacitor are respectively the first terminal and the second terminal of the storage sub-circuit.

5. The pixel driving compensation circuit according to claim 1, wherein:

the first reset sub-circuit comprises a first reset transistor;

the first reset transistor has a gate electrode connected to the reset signal terminal, a first electrode connected to the first terminal of the storage sub-circuit, and a second electrode connected to the first terminal of the light emitting component; and the first electrode of the first reset transistor is a source electrode or a drain electrode, and the second electrode of the first reset transistor is a drain electrode or a source electrode corresponding to the first electrode of the first reset transistor.

6. The pixel driving compensation circuit according to claim 1, wherein:

the second reset sub-circuit comprises a second reset transistor, the second reset transistor has a gate electrode connected to the reset signal terminal, a first electrode connected to the initial signal terminal, and a second electrode connected to the drive sub-circuit; and the first electrode of the second reset transistor is a source electrode or a drain electrode, and the second electrode of the second reset transistor is a drain electrode or a source electrode corresponding to the first electrode of the second reset transistor.

7. The pixel driving compensation circuit according to claim 1, wherein:

the control sub-circuit comprises a control transistor;

the control transistor has a gate electrode connected to the control signal terminal;

a first electrode connected to the first power supply voltage terminal, and a second electrode connected to the first terminal of the light emitting component; and the first electrode of the control transistor is a source electrode or a drain electrode, and the second electrode of the control transistor is a drain electrode or a source electrode corresponding to the first electrode of the control transistor.

8. The pixel driving compensation circuit according to claim 1, wherein:

the drive sub-circuit comprises a drive transistor;

the drive transistor has a gate electrode connected to the second terminal of the storage sub-circuit, a first electrode connected to the second terminal of the light emitting component, and a second electrode connected to the second power supply voltage terminal; and the first electrode of the drive transistor is a source electrode or a drain electrode, and the second electrode of the drive transistor is a drain electrode or a source electrode corresponding to the first electrode of the drive transistor.

9. The pixel driving compensation circuit according to claim 1, wherein:

the scan sub-circuit is a scan transistor, the storage sub-circuit is a storage capacitor, the first reset sub-circuit is a first reset transistor, the second reset sub-circuit is a second reset transistor, the control sub-circuit is a control transistor, and the drive sub-circuit is a drive transistor;

the scan transistor has a gate electrode connected to the scan signal terminal, a first electrode connected to the data signal terminal, and a second electrode connected to a first terminal of the storage capacitor;

the first reset transistor has a gate electrode connected to the reset signal terminal, a first electrode connected to the first terminal of the storage capacitor, and a second electrode connected to an anode of the light emitting component;

the second reset transistor has a gate electrode connected to the reset signal terminal, a first electrode connected to the initial signal terminal, and a second electrode connected to a gate electrode of the drive transistor;

the control transistor has a gate electrode connected to the control signal terminal, a first electrode connected to the first power supply voltage terminal, and a second electrode connected to the anode of the light emitting component;

the drive transistor has the gate electrode connected to a second terminal of the storage capacitor, a first electrode connected to a cathode of the light emitting component, and a second electrode connected to the second power supply voltage terminal;

the first electrode of each of the scan transistor, the first reset transistor, the second reset transistor, the control transistor, and the drive transistor is one of a source electrode and a drain electrode; and the second electrode of each of the scan transistor, the first reset transistor, the second reset transistor, the control transistor, and the drive transistor is the other one of the source electrode and the drain electrode.

10. A display panel, comprising;

a pixel driving compensation circuit, the pixel driving compensation circuit comprising:

a scan sub-circuit, a storage sub-circuit, a first reset sub-circuit, a second reset sub-circuit, a control sub-circuit, and a drive sub-circuit; wherein:

the scan sub-circuit is respectively connected to a scan signal terminal, a data signal terminal and a first terminal of the storage sub-circuit, the scan sub-circuit being configured to input a signal terminal;

the first reset sub-circuit is respectively connected to a reset signal terminal and the first terminal of the storage sub-circuit;

the second reset sub-circuit is respectively connected to the reset signal terminal, an initial signal terminal, a second terminal of the storage sub-circuit, and the drive sub-circuit, the second reset sub-circuit being configured to input an initial signal to the second terminal of the storage sub-circuit and the drive sub-circuit simultaneously according to the control of the reset signal terminal;

the control sub-circuit is respectively connected to a first power supply voltage terminal, and a control signal terminal; and the drive sub-circuit is respectively connected to the second terminal of the storage sub-circuit and a second power supply voltage terminal.

11. The display panel according to claim 10, further comprising a light emitting component, wherein:

a first terminal of the light emitting component is connected to the first reset sub-circuit, and the first reset sub-circuit is configured to input a signal of the first terminal of the storage sub-circuit to the first terminal of the light emitting component according to the control of the reset signal terminal;

the first terminal of the light emitting component is further connected to the control sub-circuit, and the control sub-circuit is configured to input a first power supply voltage signal of the first power supply voltage terminal to the first terminal of the light emitting component according to the control of the control signal terminal; and a second terminal of the light emitting component is connected to the drive sub-circuit, and the drive sub-circuit is configured to control the second terminal of the light emitting component and the second power supply voltage terminal to be conducted or not according to the control of the second terminal of the storage sub-circuit, to implement light emitting control.

12. The display panel according to claim 10, wherein:

the scan sub-circuit comprises a scan transistor; the scan transistor has a gate electrode connected to the scan signal terminal, a first electrode connected to the data signal terminal, and a second electrode connected to the first terminal of the storage sub-circuit; and the first electrode of the scan transistor is a source electrode or a drain electrode, and the second electrode of the scan transistor is a drain electrode or a source electrode corresponding to the first electrode of the scan transistor.

13. The display panel according to claim 10, wherein the storage sub-circuit comprises a storage capacitor, and wherein two terminals of the storage capacitor are respectively the first terminal and the second terminal of the storage sub-circuit.

14. The display panel according to claim 10, wherein:

the first reset sub-circuit comprises a first reset transistor;

the first reset transistor has a gate electrode connected to the reset signal terminal, a first electrode connected to the first terminal of the storage sub-circuit, and a second electrode connected to the first terminal of the light emitting component; and the first electrode of the first reset transistor is a source electrode or a drain electrode, and the second electrode of the first reset transistor is a drain electrode or a source electrode corresponding to the first electrode of the first reset transistor.

15. The display panel according to claim 10, wherein:

the second reset sub-circuit comprises a second reset transistor, the second reset transistor has a gate electrode connected to the reset signal terminal, a first electrode connected to the initial signal terminal, and a second electrode connected to the drive sub-circuit; and the first electrode of the second reset transistor is a source electrode or a drain electrode, and the second electrode of the second reset transistor is a drain electrode or a source electrode corresponding to the first electrode of the second reset transistor.

16. The display panel according to claim 10, wherein:

the control sub-circuit comprises a control transistor;

the control transistor has a gate electrode connected to the control signal terminal;

a first electrode connected to the first power supply voltage terminal, and a second electrode connected to the first terminal of the light emitting component; and the first electrode of the control transistor is a source electrode or a drain electrode, and the second electrode of the control transistor is a drain electrode or a source electrode corresponding to the first electrode of the control transistor.

17. The display panel according to claim 10, wherein:

the drive sub-circuit comprises a drive transistor;

the drive transistor has a gate electrode connected to the second terminal of the storage sub-circuit, a first electrode connected to the second terminal of the light emitting component, and a second electrode connected to the second power supply voltage terminal; and the first electrode of the drive transistor is a source electrode or a drain electrode, and the second electrode of the drive transistor is a drain electrode or a source electrode corresponding to the first electrode of the drive transistor.

18. The display panel according to claim 10, wherein:

the scan sub-circuit is a scan transistor, the storage sub-circuit is a storage capacitor, the first reset sub-circuit is a first reset transistor, the second reset sub-circuit is a second reset transistor, the control sub-circuit is a control transistor, and the drive sub-circuit is a drive transistor;

the scan transistor has a gate electrode connected to the scan signal terminal, a first electrode connected to the data signal terminal, and a second electrode connected to a first terminal of the storage capacitor;

the first reset transistor has a gate electrode connected to the reset signal terminal, a first electrode connected to the first terminal of the storage capacitor, and a second electrode connected to an anode of the light emitting component;

the second reset transistor has a gate electrode connected to the reset signal terminal, a first electrode connected to the initial signal terminal, and a second electrode connected to a gate electrode of the drive transistor;

the control transistor has a gate electrode connected to the control signal terminal, a first electrode connected to the first power supply voltage terminal, and a second electrode connected to the anode of the light emitting component;

the drive transistor has the gate electrode connected to a second terminal of the storage capacitor, a first electrode connected to a cathode of the light emitting component, and a second electrode connected to the second power supply voltage terminal;

the first electrode of each of the scan transistor, the first reset transistor, the second reset transistor, the control transistor, and the drive transistor is one of a source electrode and a drain electrode; and the second electrode of each of the scan transistor, the first reset transistor, the second reset transistor, the control transistor, and the drive transistor is the other one of the source electrode and the drain electrode.

19. A driving method for a pixel driving compensation circuit, the driving method comprising a reset stage, a driving stage and a light emitting stage in sequence, wherein the driving method comprises:

providing the pixel driving compensation circuit, the pixel driving compensation circuit comprising:

a scan sub-circuit, a storage sub-circuit, a first reset sub-circuit, a second reset sub-circuit, a control sub-circuit, a drive sub-circuit, and a light emitting component, wherein:

the scan sub-circuit is respectively connected to a scan signal terminal, a data signal terminal, and a first terminal of the storage sub-circuit, the scan sub-circuit being configured to input a data signal to the first terminal of the storage sub-circuit according to a control of the scan signal terminal;

the first reset sub-circuit is respectively connected to a reset signal terminal and the first terminal of the storage sub-circuit;

the second reset sub-circuit is respectively connected to the reset signal terminal, an initial signal terminal, a second terminal of the storage sub-circuit, and the drive sub-circuit, the second reset sub-circuit configured to input an initial signal to the second terminal of the storage sub-circuit and the drive sub-circuit simultaneously according to a control of the reset signal terminal;

the control sub-circuit is respectively connected to a first power supply voltage terminal, and a control signal terminal;

the drive sub-circuit is respectively connected to the second terminal of the storage sub-circuit and a second power supply voltage terminal;

a first terminal of the light emitting component is connected to the first reset sub-circuit, and the first reset sub-circuit is configured to input a signal of the first terminal of the storage sub-circuit to the first terminal of the light emitting component according to the control of the reset signal terminal;

the first terminal of the light emitting component is further connected to the control sub-circuit, and the control sub-circuit is configured to input a first power supply voltage signal of the first power supply voltage terminal to the first terminal of the light emitting component according to the control of the control signal terminal; and a second terminal of the light emitting component is connected to the drive sub-circuit, and the drive sub-circuit is configured to control the second terminal of the light emitting component and the second power supply voltage terminal to be conducted or not according to the control of the second terminal of the storage sub-circuit, to implement light emitting control;

wherein, in the reset stage, the reset signal terminal controls the first reset sub-circuit to conduct the first terminal of the storage sub-circuit with the first terminal of the light emitting component, and further controls the second reset sub-circuit to input an initial signal of the initial signal terminal to a second terminal of the storage sub-circuit and the drive sub-circuit; the scan signal terminal controls the scan sub-circuit to be turned off; and the control signal terminal controls the control sub-circuit to be turned off;

wherein, in the driving stage, the scan signal terminal controls the scan sub-circuit to input a data signal of the data signal terminal to the first terminal of the storage sub-circuit; the reset signal terminal controls the first reset sub-circuit and the second reset sub-circuit to be turned off, and the control signal terminal controls the control sub-circuit to be turned off; and wherein, in the light emitting stage, the scan signal terminal controls the scan sub-circuit to be turned off; the reset signal terminal controls the first reset sub-circuit and the second reset sub-circuit to be turned off; and the control signal terminal controls the control sub-circuit to input a first power supply voltage signal of the first power supply voltage terminal to the first terminal of the light emitting component, to cause the light emitting component to emit light.

* * * * *